US008187985B2

(12) United States Patent
Rautray

(10) Patent No.: US 8,187,985 B2
(45) Date of Patent: May 29, 2012

(54) ALL PURPOSE ABRASIVE NON-WOVEN PAD/SCRUBBER AND A PROCESS FOR ITS MANUFACTURE

(75) Inventor: Namita Rautray, Bhubaneswar (IN)

(73) Assignee: Inovex Enterprises (P) Ltd., Bhubaneswar (IN)

( * ) Notice: Subject to any disclaimer, the term of this patent is extended or adjusted under 35 U.S.C. 154(b) by 386 days.

(21) Appl. No.: 12/445,008

(22) PCT Filed: Jul. 9, 2008

(86) PCT No.: PCT/IN2008/000438

§ 371 (c)(1), (2), (4) Date: Apr. 9, 2009

(87) PCT Pub. No.: WO2009/133566

PCT Pub. Date: Nov. 5, 2009

(65) Prior Publication Data

US 2010/0132144 A1 Jun. 3, 2010

(30) Foreign Application Priority Data

May 1, 2008 (IN) ..... 801/KOL/2008

(51) Int. Cl.

| | |
|---|---|
| ***D04H 1/00*** | (2006.01) |
| ***D04H 1/58*** | (2006.01) |
| ***D04H 1/64*** | (2006.01) |
| ***B32B 27/40*** | (2006.01) |
| ***B32B 27/32*** | (2006.01) |
| ***A47K 7/02*** | (2006.01) |
| ***D02G 3/00*** | (2006.01) |

(52) U.S. Cl. ..... 442/327; 442/59; 442/148; 442/152; 15/208; 428/364; 428/365

(58) Field of Classification Search ..... 442/59, 442/152–163, 321, 327–417; 428/364, 365; 15/208

See application file for complete search history.

(56) References Cited

U.S. PATENT DOCUMENTS

| | | | | |
|---|---|---|---|---|
| 3,034,169 | A | 5/1962 | Richier | |
| 3,810,841 | A | 5/1974 | Richter | |
| 4,965,129 | A | 10/1990 | Bair | |
| 5,518,794 | A * | 5/1996 | Barber et al. | 428/95 |
| 6,632,863 | B2 * | 10/2003 | Hutchison et al. | 524/13 |
| 2008/0223302 | A1 * | 9/2008 | Wang et al. | 119/173 |

FOREIGN PATENT DOCUMENTS

| | | |
|---|---|---|
| JP | 10-295607 | 11/1998 |
| JP | 2000-34299 | 12/2000 |
| JP | 2003-235774 | * 8/2003 |

OTHER PUBLICATIONS

Search Report mailed Oct. 20, 2008 in PCT/IN2008/000438.
Written Opinion of ISA mailed Oct. 20, 2008 in PCT/IN2008/000438.

* cited by examiner

*Primary Examiner* — Jennifer Steele
(74) *Attorney, Agent, or Firm* — The Law Office of Michael E. Kondoudis

(57) ABSTRACT

Abrasive pads/scrubbers used for cleaning utensils and the like which usually involve rubbing of the pad along with some applied detergent/cleansing agent on the surface to be cleaned. More particularly, the invention is directed to an all purpose abrasive pad obtained of treated white coir which would be user friendly, durable with the loose fibers effectively interlocked and also having glossy, flexible, non-odour and tack free touch abrasive texture. Unlike the conventional synthetic fibers and metallic wool based abrasive pads, the treated white coir abrasive pad is found to be hygienic and free of any odour or be prone to microbes and advantageously durable maintaining its desired shape and texture even after repeated use and applications. The simple natural fibre based abrasive pads having effective lifespan and also safe and hygienic favoring handling conditions in various applications.

3 Claims, No Drawings

ALL PURPOSE ABRASIVE NON-WOVEN PAD/SCRUBBER AND A PROCESS FOR ITS MANUFACTURE

CROSS REFERENCE TO RELATED APPLICATIONS

This is a national stage application of PCT/IN2008/000438 filed 9 Jul. 2008, and claims the benefit of Indian Application No. 801/KOL/2008, filed 1 May 2008.

FIELD OF THE INVENTION

The present invention relates to abrasive pads such as those used for cleaning subjects such as utensils and the like which usually involve rubbing of the pad along with some applied detergent/cleansing agent on the surface to be cleaned. More particularly, the invention is directed to an all purpose abrasive pad obtained of treated white coir which would be user friendly, durable with the loose fibers effectively interlocked and also having glossy, flexible, non-odour and tack free touch abrasive texture. Importantly, unlike the regularly available abrasive pads including those obtained of synthetic fibers and metallic wool based abrasive pads the treated white coir abrasive pad is found to be hygienic to use and would not attract odour or be prone to microbes and furthermore is adapted to be durable maintaining its desired shape and texture even after repeated use and applications. The treated white coir based abrasive pad of the invention thus on one hand makes advantageous use of natural fibre such as coir fibres and on the other hand ensures and avoids the problems and disadvantages associated with simple natural fibre based abrasive pads such as the untreated loose coir based abrasive pads which have a very short effective lifespan and also is found to be unhygienic being difficult to keep clean and safe of microbes and difficult handling conditions.

BACKGROUND ART

It is well known to use abrasive pads for the cleaning of variety of subjects especially utensils and the like to make it free of sticky oily dirt and allied unhygienic conditions so as to restore the same in good condition before every use.

There are various types of abrasive pads available in the world such as Non-woven nylon, impregnated with abrasive grain and bonded with heavy resins, plastic round scrubbers, steel wool, micro fiber Terry pad made from polyester mesh, metal sponges, coir brushes, coir rope and most commonly used is loose coir fibers.

The fast moving abrasive pads since long which have been used are made from synthetic fibers of nylon and polyester which when used with any type of detergents are noticeably affected by deterioration, degradation, and slow breakdown. Hence the whole useful purpose of an abrasive pad no longer solves the purpose of cleaning action but merely turns into a soft cloth.

Metallic Bronze Alloy, copper and steel wool are also available but are too harsh, scratch and usually when left over a short period rusts. All these pads after use are found to retain soap suds making the pads attract odor and prone to microbes which can escape onto the surface of articles to be cleaned.

The economical plastic scrubbers available, loose their shape and slip on the surface as the pads are made from smooth plastic threads.

The widely used ancient abrasive scrubber involve loose coir fibres. Still today it is used widely used in rural areas, lower economic sections in countries where coirs are readily available such as in India. However, such coir based scrubbers although are readily and almost freely available have several disadvantages such as the fibers become wet, dark and attract foul odor as coir fiber to a certain extent does not absorb water. It becomes a messy affair as some fibers are left on the surface.

OBJECTS OF THE INVENTION

It is thus the basic object of the present invention to provide for an all purpose abrasive pad which can be sourced from readily available and a very good natural abrasive coconut fibre and yet be durable and hygienic to use and also be simple and cost-effective to obtain.

Another object of the present invention is directed to the development of a treated coir based abrasive pad which would be hygienic and user friendly and avoid the limitations and disadvantages of the loose coir as abrasive material used in the art and in particular be durable with on one hand effective fibers interlocking and on the other hand having glossy, flexible, non-odour and tack free touch abrasive texture.

A further object of the present invention is directed to a treated coir based abrasive which be safe and hygienic to use and would not attract odour or be prone to microbes and furthermore would be adapted to be durable maintaining its desired shape and texture even after repeated use and applications.

Another object of the present invention is directed to treated coir based abrasive pad of the invention thus on one hand makes advantageous use of natural fibre such as coir fibres and on the other hand ensures and avoids the problems and disadvantages associated with simple natural fibre based abrasive pads such as the untreated loose coir based abrasive pads which have a very short effective lifespan and also is found to be unhygienic being difficult to keep clean and safe of microbes and difficult handling conditions.

A further object of the invention is directed to develop useful abrasive products made from coir fibers which have always been limited to use only either making the coir into a brush, mat rope for cleaning.

Another object of the present invention is directed to develop user friendly and safe scrubber making advantageous use of the coirs natural abrasive texture, color brilliance especially those found in white fiber.

Yet another object of the invention is directed to the development of a coir based compact handy abrasive scrubber/pad, which would be flexible, tough, gentle, yet effective abrasion resistant and adapted such as not to loose it's shape after multiple uses like all the existing abrasive pads.

A further object of the present invention is directed to the development of a durable coir based abrasive pad which would meet the requirement for an effective and durable abrasive pad required for regular purposes by mankind such as to ensure that there is no need for repeated buying of a cleaning instrument of any kind which will help us to sustain our Environment, making this development a truly environmental sustainable product.

SUMMARY OF THE INVENTION

Thus according to the basic aspect of the present invention there is provided an all purpose abrasive non-woven pad comprising:

non-woven natural saline water pre-treated white coir fibers having a polymeric coating cum adhesive formulation adapted for required interlocking and durability of the coir fibres adapted as an abrasive pad.

In accordance with an aspect the above all purpose abrasive non-woven pad of the invention comprises:

non-woven natural saline water pre-treated white coir fibers with a polymeric coating comprising a polymer blend of cellulose polyolefin pellets and thermoplastic polyurethane with a chain extender.

In accordance with a preferred aspect the said all purpose abrasive non-woven pad include said polymeric coating obtained of said cellulose polyolefin pellets in amounts of 5.5% to 6.5% by wt. and said thermoplastic polyurethane in amounts of 3.5 to 4.5% preferably with polyisocynate in amounts of 0.5% to 1% by wt. as the chain extender with or without pigments in the range of 0.5 to 1.0% by wt.

Advantageously, the said all purpose abrasive non-woven pad according to the invention comprises a glossy, flexible, non-odour and tack free touch abrasive texture.

In accordance with another preferred aspect of the invention, the said all purpose abrasive non-woven pad comprises preferably of dimensions in the range of 7 mm to 9 mm (thickness)×100 mm to 103 mm (length)×70 mm to 75 (breadth) abrasive pad.

In accordance with another aspect of the present invention there is provided a process of the manufacture of an all purpose abrasive non-woven pad comprising:

i) providing white loose coir fibers pre-treated with saline soaking such as to provide white coir fibres adapted for accepting a polymeric coating cum adhesive treatment;
ii) providing a polymeric adhesive cum coating formulation comprising blending cellulose polyolefin pellets and thermoplastic polyurethane in a low boiling organic solvent with a chain extruder;
iii) spraying the said polymeric adhesive cum coating formulation of step ii) above onto the white loose coir fibres; and
iv) subjecting the thus sprayed coir fibres to heating in the temperature range of 30 to 50 degrees centigrade to thereby evaporate the solvent and provide the tack free touch dried abrasive non-woven pad.

In accordance with a preferred aspect in the above process of the manufacture of an all purpose abrasive non-woven pad of the invention:

said step of providing white loose coir fibers pre-treated with saline soaking comprises soaking the coir pods in saline water 5% to 7% by wt. of salt for a period of 5 to 7 days preferably seven days prior to extraction of the husk whereby the fiber in the husk are rendered softer brighter in colour and the lignin ready to accept the polymeric coat cum adhesive formulation thereon; and said step of providing of the polymeric adhesive cum coating formulation comprises providing the polymeric blend of cellulose polyolefin pellets in the range of 5.5% to 6.5% by wt. and thermoplastic polyurethane in the range of 3.5% to 4.5% by wt. in a mixer and subjecting the same to mixing along with a low boiling organic solvent till dissolution which is followed by addition of a chain extender in amounts of 0.5% to 1% by wt. optionally with or without pigments in amounts of 0.5% to 1.0% by wt. of the coating cum adhesive formulation.

Preferably, the said step of spraying is carried out by a suitable air assisted, low pressure, spray equipment adapted such as to ensure that each strand of the fiber received the coating cum adhesive formulation.

The said low boiling solvent used in the process is preferably selected from low boiling solvents preferably toluene, methyl ethyl ketone, carbon tetrachloride and ethyl chloride.

Importantly, in the above discussed process of the invention, the said step of heating the sprayed coir fibres to temperature range of 30 to 50 degrees centigrade is carried out to attain the end point for interlocking the fibres with the said tack free touch preferably involving a circulating oven with temperature ranging from 30 to 50 degrees centrigrade.

In accordance with a further aspect of the invention the dried abrasive non-woven pad is subjected to pressing in a hydraulic press immediately after the solvent is evaporated to thereby obtain pad in the form of pressed sheets of coated fibers with desired interlocking and durability.

The pressed sheet are cut into dimensions of abrasive pads of size preferably 7 mm to 9 mm thickness×100 mm to 103 mm (length)×70 mm to 75 mm (breadth) pads.

In accordance with yet another aspect of the invention there is provided for treatable natural fibres adapted for ready bonding with treatment polymeric and/or adhesive coatings for variety of end use applications comprising:

said treatable natural fibres obtained of soaking of the pods in saline water 5% to 7% by wt. of salt for a period of 5 to 7 days preferably about seven days prior to extraction of the husk whereby the fiber in the husk are rendered softer brighter in colour and the lignin ready to bond with the treatment polymeric and/or adhesive formulation thereon.

According to yet further aspect of the present invention there is provided white coir fibres suitable for variety of end use/applications comprising fibres obtained of pre-treatment with saline water.

Importantly, the said white coir fibres of the invention have lignin adapted for ready bonding with polymeric and/or adhesive coatings. Also, the thus saline treated white coir fibres of the invention are found to have softer and brighter colour characteristics.

It would be apparent from the above that the abrasive product of the invention involving the treated white coir fiber which is transformed into a non woven compact pad using a formulation is specifically adapted to act as an adhesive cum coating agent favours interlocking each and every single strand of fiber into a compact pad. A fine coating is done to ensure that coir natural abrasive texture and color is unaltered. It is thus possible by way of the present invention to provide for the first time a coir based abrasive turning all the disadvantages to advantages of all the prevailing scrubbers in the world, by way of the selective pre treated white coir and its compatible polymeric and adhesive coat to reach to the quality scrubber/abrasive pad with requisite qualities and characteristics.

Importantly also, the product of the invention is economical as compared to all other existing scrubber/abrasive pad products which have a limited abrasive action for a short duration for effective cleaning action whereas the white coir based scrubber of the invention is adapted to retain it's abrasive action, remain in shape, texture and not attract fowl odor thus making it hygienic and retaining its aesthetic appearance for multi purpose uses, which would have a tremendous lead over all other existing abrasive pads.

DETAILED DESCRIPTION OF THE INVENTION

The invention involved detailed in depth study of the properties of brown and white coir fibers and identifying the selective suitability of the white coir fibres as a suitable abrasive pad material. It was found that both white and brown lacked the surface texture to take any treatment what so ever given and for that reason till date all existing coir based abrasive materials has used raw coir for a cleaning aid in the form of brushes and ropes tied together or sewed.

It is specifically found by way of the present invention that a selective pre treatment by way of saline soaking of white coir could ensure that the white fibers would accept the adhesive and coating process and also these fibers could then be used for a multi purpose cleaning. Brown fiber lacked the texture as they are more brittle and their lignin layer got destroyed on treatment by the special retting method adopted under the invention.

Importantly, according to the invention the pods are soaked in a pit for about 5 to 7 days preferably about seven days with saline water of 5% to 7% salt by weight, prior to extraction of husk. This treatment is selective and special by which the fiber in the husk get softer, bright in color and the lignin are ready to have a stuck on process for the polymeric coating.

In accordance with a further aspect of the invention the same is directed to the development of a coating cum adhesive formulation which would benefit imparting on the white coir fibres the required characteristics to take care and prevent the fiber from reacting to harsh detergents, not deteriorate, not be harsh as metallic meshes, not absorb water as coir fiber has a limiting water resistance, remain flexible, not attract dirt, retain abrasive texture after the treatment and most of all have a property to stick onto the lignin. Advantageously, the coating cum adhesive formulation in the present invention is adapted to act as a thin coating in microns, cross linking each fiber and favour a simple and cost-effective manufacturing process for producing the abrasive pad/scrubber of the invention.

The manufacturing of the coating cum adhesive formulation as above according to the invention is basically comprised of (i) a polymer blend of cellulose polyolefin pellets with a range of 5.5% to 6.5% by weight and 3.5% to 4.5% by weight of thermoplastic polyurethane placed in a mixer and of rpm range of 500 to 1000 along with a low boiling solvent preferably selected from toluene, methyl ethyl ketone, carbon tetrachloride and ethyl chloride are mixed till dissolution and (ii) a chain extender preferably polyisocynate composition with 0.5% to 1% by weight.

Importantly, the above invention involving the selective saline pretreatment of fibres can turn the utility of other natural fibers available such as jute and sisal to prevent depleting our natural resources in order to preserve the environment. Major use for white coir so far has been for rope manufacture, door mats, but never has it been used as an abrasive pad. The present invention would thus favour a sustainable product providing the full commercial cycle from extraction of raw materials to the final disposition by helping the environment in social and economic benefits.

The details of the invention, its objects and advantages are explained hereunder in greater detail in relation to non-limiting exemplary illustrations as per the following examples:

EXAMPLES

Example I

The process of producing the abrasive pad/scrubber in accordance with the invention involving the pretreated white coir is explained hereunder in detail:

A. Pre Treatment of the White Coir Pods:

Coir pods are soaked in saline water 6% by weight of salt for about seven days. This favoured the micro organisms to break down the plant tissues and surround the fibers to loosen them and enhance the color, and prepare the lignin for a stuck on treatment. Segments of the husk are then beaten and long fibres separate out which are subsequently dried and cleaned.

B. Preparation of the Coating cum Adhesive Formulation:

(i) Polymer blend of cellulose polyolefin pellets 6% by weight and 4% by weight of thermoplastic polyurethane were taken. This was placed in a mixer of 500 to 1000 rpm with a low boiling organic solvent Toluene which was allowed to mix for about an one hour.

(ii) A chain extender, polyisocynate composition 1% by weight was next added to the blend of (i) above and mixed for 10 minutes which was then allowed to stand for about 15 minutes for complete aeration. The mix thus obtained comprised of the coating cum adhesive formulation and was stored in stainless steel drums in air tight conditions maintaining its effectiveness.

C. Spraying of the Coating cum Adhesive Formulation on Pretreated White Coir:

The Formulation under B) above was next sprayed uniformly on to loose pretreated white coir fibers obtained from A) above.

D) Heating of the Sprayed coir fibre for Solvent Evaporation:

The sprayed fibre sheets were placed into a circulating oven with temperature range of 30 to 50 degrees centigrade for complete evaporation of solvent. Then pressed lightly into a compact sheet. For sustained adhesion the pad is left for 24 hours before the next step.

E) Finally the Treated Fibre Sheets are Cut into Sized Abrasive Pads:

The treated sheets obtained under D) above are next cut to desired shape and size to suit end user requirements.

Example II & III

In the processes under Examples II (brown fiber) and III (white fibre) the same process was followed except that the step A of example I was not followed i.e. spraying of the coating cum adhesive formulation on brown fiber (Example II) and white fiber without giving any pre treatment.

It was found that unlike the product under Example I above and the product under Examples II and III showed that raw fiber could not accept the coating cum adhesive formulation of the invention. The material obtained under Examples II and III showed signs of yellowing and water penetration after a period of time.

Contrary to the above results in the products in examples II and III there was remarkable results after the saline treatment given to the coconut pods prior to fiber extraction, for the fiber to have a stuck on property and better abrasive texture and color as per the product obtained following Example I.

Example IV

Under this example the same stages as that of the Example I was followed but a single pact polymer formulation was tried unlike the two pact polymer formulation of Example I and it was found that it could not achieve the features required by the abrasive pad of the invention but pealed and could not interlock the fibers. This confirmed the requirement of the two pact formulation which lead to the features of a desirable abrasive pad in accordance with the present invention.

It is thus possible by way of the present invention to provides an all purpose non woven abrasive pad made from treated white coir fiber only, coated with a adhesive cum coating formulation to compress and interlock the fibers into an abrasive pad. This white coir based abrasive pad/scrubber has excellent abrasive texture of natural fiber, free from microbes, does not degenerate or splinter on several uses, flexible, soft, safe, no odor and not brittle, removes dirt, burnt and impossible stains. Importantly, the white coir based abrasive pad is found to have tremendous shelf life, and even the most abrasive action or harsh detergents cannot wear the fibers down. Advantageously the invention is adapted to further take care of the environment by sustaining our resources and make the white coir based abrasive pad the most sort out abrasive product for multipurpose applications and use.

What is claimed is:

1. An all purpose abrasive non-woven pad/scrubber comprising:

non-woven natural saline water pre-treated white coir fibers having a polymeric coating cum adhesive formulation comprising an organic solvent based formulation having cellulose polyolefin pellets in amounts of 5.5% to 6.5% by wt. and thermoplastic polyurethane in amounts of 3.5 to 4.5% with polyisocyanate in amounts of 0.5% to 1% by wt. as the chain extender with or without pigments in the range of 0.5 to 1.0% by wt. for required interlocking and durability of the coir fibres adapted as an abrasive pad.

2. An all purpose abrasive non-woven pad/ scrubber according to claim 1 comprising a glossy, flexible, non-odour and tack free touch abrasive texture.

3. An all purpose abrasive non-woven pad/ scrubber according to claim 1 comprising preferably of dimensions in the range of 7 mm to 9 mm (thickness)×100 mm to 103 mm (length)×70 mm to 75 (breadth) abrasive pad.

* * * * *